US012540432B2

(12) United States Patent
Han et al.

(10) Patent No.: US 12,540,432 B2
(45) Date of Patent: Feb. 3, 2026

(54) HEAT EXCHANGER AND MANUFACTURING METHOD OF HOME APPLIANCE INCLUDING THE HEAT EXCHANGER

(71) Applicant: LG Electronics Inc., Seoul (KR)

(72) Inventors: Sangkwon Han, Seoul (KR); Myeongdeok Kim, Seoul (KR); Jeonggeun Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 113 days.

(21) Appl. No.: 18/415,165

(22) Filed: Jan. 17, 2024

(65) Prior Publication Data

US 2024/0150955 A1 May 9, 2024

Related U.S. Application Data

(63) Continuation of application No. 16/992,800, filed on Aug. 13, 2020, now Pat. No. 11,913,163.

(30) Foreign Application Priority Data

Aug. 14, 2019 (KR) ..... 10-2019-0099748
Jan. 29, 2020 (KR) ..... 10-2020-0010694

(51) Int. Cl.
*D06F 58/20* (2006.01)
*D06F 58/02* (2006.01)
(Continued)

(52) U.S. Cl.
CPC ..... *D06F 58/206* (2013.01); *D06F 58/02* (2013.01); *D06F 58/24* (2013.01); *F28F 19/02* (2013.01)

(58) Field of Classification Search
CPC ..... D06F 58/206; D06F 58/02; D06F 58/24; F28F 19/02; F28F 1/32; F28D 1/0477
See application file for complete search history.

(56) References Cited

U.S. PATENT DOCUMENTS 1,710,811 A * 4/1929 Dewald ..... F28F 1/36 29/451
1,799,691 A * 4/1931 Karmazin ..... F28F 1/02 165/149
(Continued)

FOREIGN PATENT DOCUMENTS

CN 103846638 6/2014
CN 208579665 3/2019
(Continued)

OTHER PUBLICATIONS

Extended European Search Report in European Appln. No. 23198953.4, mailed on Jan. 29, 2024, 9 pages.
(Continued)

*Primary Examiner* — Edelmira Bosques
*Assistant Examiner* — Bao D Nguyen
(74) *Attorney, Agent, or Firm* — Fish & Richardson P.C.

(57) ABSTRACT

A heat exchanger includes: a copper pipe forming a refrigerant circulation passage; and a plurality of fins arranged at positions spaced apart from each other along one direction and coupled to an outer circumferential surface of the copper pipe, wherein the copper pipe includes: a plurality of straight tubes extending along the arranged direction of the plurality of fins; and a plurality of return bends connected to one end of one of the plurality of straight tubes and one end of another one of the plurality of straight tubes by welding, wherein burrs having a circumference greater than an outer diameter of each straight tube are formed at both ends of the plurality of straight tubes, a distance between a rim of the burr and an outer surface of the straight tube is 0.4 mm to 1.8 mm.

20 Claims, 8 Drawing Sheets

(51) Int. Cl.
*D06F 58/24* (2006.01)
*F28F 19/02* (2006.01)

(56) References Cited

U.S. PATENT DOCUMENTS 1,894,956 A * 1/1933 Kerr ..... F28F 9/04 110/304
1,894,957 A * 1/1933 Lucke ..... F28F 19/02 110/304
1,926,460 A * 9/1933 Slagel ..... F28F 9/26 285/134.1
1,931,467 A * 10/1933 Young ..... F28D 1/0477 165/172
2,001,186 A * 5/1935 Dornier ..... F28F 19/004 165/148
2,347,957 A * 5/1944 Mccullough ..... F28F 1/16 165/172
2,676,791 A * 4/1954 White ..... F25B 39/04 165/126
2,758,822 A * 8/1956 Sauter ..... F24D 3/02 165/59
3,209,820 A * 10/1965 Lauterbach ..... F28F 9/0273 165/174
3,750,248 A * 8/1973 Morris ..... F28F 1/32 228/183
3,815,672 A * 6/1974 Bullard ..... F28D 1/0477 29/890.047
3,849,854 A * 11/1974 Mattioli ..... F28F 21/084 228/183
4,195,687 A * 4/1980 Taziker ..... F28F 1/12 392/354
4,256,475 A * 3/1981 Schafer ..... F25B 13/00 62/238.7
4,310,476 A * 1/1982 Nahra ..... F28D 3/04 261/129
4,335,677 A * 6/1982 Nagata ..... B05B 13/0627 118/DIG. 10
4,341,262 A * 7/1982 Alspaugh ..... F28D 20/023 165/10
4,370,944 A * 2/1983 Nagata ..... B05B 7/066 118/317
4,434,843 A * 3/1984 Alford ..... F28D 1/0477 29/890.047
4,502,532 A * 3/1985 Tomozaki ..... F28F 9/182 165/150
4,503,907 A * 3/1985 Tanaka ..... F28F 19/02 165/909
4,664,182 A * 5/1987 Miwa ..... F28F 13/18 62/272
4,690,209 A * 9/1987 Martin ..... F25B 47/006 165/149
4,993,485 A * 2/1991 Gorman ..... F28F 13/125 165/158
5,150,749 A * 9/1992 Bergmann ..... F25B 9/006 62/515
5,190,101 A * 3/1993 Jalilevand ..... F28F 9/0214 165/173
5,211,221 A * 5/1993 Lease ..... F28F 9/26 29/890.036
5,299,633 A * 4/1994 Bruggemann ..... F28D 7/08 62/93
5,510,010 A * 4/1996 Kobor ..... C23C 22/63 204/488
5,511,831 A * 4/1996 Barton ..... F16L 25/10 285/915
6,349,761 B1 * 2/2002 Liu ..... F28F 13/12 165/181
6,405,428 B1 * 6/2002 Mun ..... F28D 1/0477 29/726
6,500,490 B1 * 12/2002 Yan ..... C23C 18/1212 427/430.1
8,375,596 B2 2/2013 Grunert et al.
2003/0098145 A1 * 5/2003 Tada ..... H01M 8/04067 165/166
2003/0121647 A1 * 7/2003 Roo ..... F28F 1/32 165/150
2004/0079121 A1 * 4/2004 Yabuuchi ..... D06F 25/00 68/19
2004/0250422 A1 * 12/2004 Ali ..... B23P 15/26 29/890.047
2005/0061492 A1 * 3/2005 Kurihara ..... F28F 1/42 165/150
2005/0086827 A1 * 4/2005 Nagae ..... F28F 1/32 34/218
2005/0086965 A1 * 4/2005 Lalumiere ..... F28F 1/32 62/277
2005/0133209 A1 * 6/2005 Song ..... F28D 1/0426 165/151
2005/0150249 A1 7/2005 Ha et al.
2006/0124287 A1 * 6/2006 Reinders ..... F24F 5/0035 165/177
2008/0283228 A1 * 11/2008 Ohwaki ..... C23C 28/00 165/151
2009/0038173 A1 * 2/2009 Ahn ..... D06F 58/24 34/130
2009/0038178 A1 * 2/2009 Ahn ..... D06F 58/24 165/181
2009/0094852 A1 * 4/2009 Tatsumi ..... D06F 58/206 34/132
2009/0223077 A1 * 9/2009 Grunert ..... D06F 58/22 34/82
2010/0006277 A1 * 1/2010 Ohwaki ..... C09D 127/12 165/185
2010/0044023 A1 * 2/2010 Canales ..... F28F 9/26 29/890.047
2010/0107703 A1 * 5/2010 Hisano ..... D06F 58/206 68/20
2010/0170101 A1 * 7/2010 Taniguchi ..... D06F 58/30 165/181
2010/0192623 A1 * 8/2010 Cittadini ..... F25B 41/40 62/498
2010/0192639 A1 * 8/2010 Kim ..... D06F 58/30 68/20
2010/0307020 A1 * 12/2010 Pillot ..... F28D 1/0477 165/181
2011/0000097 A1 * 1/2011 Grunert ..... D06F 58/24 34/73
2011/0203780 A1 * 8/2011 Jiang ..... F28F 9/0273 165/173
2011/0220334 A1 * 9/2011 Olsson ..... F28F 9/0256 165/167
2011/0259040 A1 * 10/2011 Cataldo ..... F28F 19/04 427/404
2011/0277334 A1 * 11/2011 Lee ..... D06F 58/206 34/73
2011/0280736 A1 * 11/2011 Lee ..... D06F 58/50 417/26
2011/0289794 A1 * 12/2011 Noh ..... F26B 23/005 34/443
2012/0030960 A1 * 2/2012 Ryoo ..... D06F 58/206 34/86
2012/0036718 A1 * 2/2012 Stroup, Sr. ..... F28F 1/06 29/890.035
2012/0079735 A1 * 4/2012 Lee ..... F25B 41/347 34/524
2013/0098591 A1 * 4/2013 Taras ..... F28F 1/10 165/181
2014/0013616 A1 * 1/2014 Lee ..... D06F 58/24 34/88
2014/0150662 A1 * 6/2014 Vandermeulen ..... B01D 53/265 96/295
2014/0151001 A1 * 6/2014 Gage ..... F28F 19/02 427/256
2014/0261764 A1 * 9/2014 Kohavi ..... F28F 9/0275 137/340
2014/0298671 A1 * 10/2014 Lee ..... D06F 58/04 34/108

(56) References Cited

U.S. PATENT DOCUMENTS

2014/0366397 A1* 12/2014 Wakizaka ..... D06F 58/206 34/524
2015/0107286 A1* 4/2015 Jin ..... F25B 13/00 62/324.6
2015/0107288 A1* 4/2015 Rabe ..... F28F 9/0131 62/298
2015/0159958 A1* 6/2015 Kimura ..... F28F 3/12 165/104.11
2015/0276328 A1* 10/2015 Huang ..... B23P 15/26 29/890.03
2015/0322616 A1* 11/2015 Dal Ben ..... D06F 34/10 62/238.7
2016/0040350 A1* 2/2016 Xu ..... D06F 58/206 34/443
2016/0061536 A1* 3/2016 Arment ..... F28F 9/262 165/181
2016/0115636 A1* 4/2016 Kim ..... D06F 58/22 68/18 F
2016/0115639 A1* 4/2016 Kim ..... D06F 58/22 34/604
2016/0115641 A1* 4/2016 Kim ..... D06F 58/10 34/132
2016/0168777 A1* 6/2016 Bison ..... D06F 58/206 62/238.7
2016/0178246 A1* 6/2016 Toyooka ..... F25B 9/008 62/502
2016/0187038 A1* 6/2016 Toyooka ..... F28D 7/14 62/474
2016/0298283 A1* 10/2016 Karagoz ..... D06F 58/206
2016/0362829 A1* 12/2016 Jung ..... D06F 58/206
2017/0191211 A1* 7/2017 Kim ..... D06F 58/206
2017/0191213 A1* 7/2017 Kim ..... D06F 58/206
2017/0268159 A1* 9/2017 Brown ..... D06F 58/30
2017/0314181 A1 11/2017 Wakizaka et al.
2018/0030644 A1* 2/2018 Hong ..... D06F 58/24
2018/0142408 A1* 5/2018 Ahn ..... D06F 58/46
2018/0171537 A1* 6/2018 Lee ..... B08B 3/14
2018/0214963 A1* 8/2018 Hosono ..... B23K 1/002
2018/0237980 A1* 8/2018 Xu ..... D06F 58/206
2018/0245269 A1* 8/2018 Bing ..... D06F 58/206
2019/0017755 A1* 1/2019 Kim ..... B23K 31/02
2019/0024299 A1* 1/2019 Ryu ..... D06F 58/22
2019/0106832 A1* 4/2019 Cagliani ..... D06F 25/00
2019/0106833 A1* 4/2019 Cagliani ..... D06F 58/22
2019/0284749 A1* 9/2019 Dunn ..... D06F 58/24
2020/0370234 A1* 11/2020 Brisjö ..... D06F 58/206
2021/0010195 A1* 1/2021 Brisjö ..... D06F 34/08
2021/0017697 A1* 1/2021 Seok ..... D06F 58/26
2021/0164154 A1* 6/2021 Brisjö ..... D06F 58/206
2021/0187559 A1* 6/2021 Kim ..... D06F 58/20
2021/0230788 A1* 7/2021 Lee ..... D06F 58/20
2022/0056630 A1* 2/2022 Cavarretta ..... D06F 58/20

FOREIGN PATENT DOCUMENTS

CN 114270127 7/2023
EP 0745824 12/1996
EP 2738506 6/2014
JP 2006-125659 5/2006
KR 10-2000-0060105 10/2000
KR 10-2000-0068214 11/2000
KR 10-2005-0047855 5/2005
KR 10-2013-0138484 12/2013
KR 10-2014-0059752 5/2014
KR 10-2017-0117130 10/2017
WO WO 2015/056416 4/2015
WO WO 2015/068092 5/2015

OTHER PUBLICATIONS

Extended European Search Report in European Appln. No. 20190858.9, dated Mar. 9, 2021, 10 pages.
International Search Report in International Application No. PCT/KR2020/009639, dated Oct. 27, 2020, 47 pages (with English translation).

* cited by examiner

HEAT EXCHANGER AND MANUFACTURING METHOD OF HOME APPLIANCE INCLUDING THE HEAT EXCHANGER

CROSS-REFERENCE TO RELATED APPLICATIONS

This application is a continuation of U.S. application Ser. No. 16/992,800, filed on Aug. 13, 2020, which claims the benefit of the earlier filing date and the right pursuant to 35 U.S.C. § 119(a) of priority to Korean Patent Application No. 10-2019-0099748, filed on Aug. 14, 2019, and Korean Patent Application No. 10-2020-0010694, filed on Jan. 29, 2020, the contents of which are incorporated by reference herein in their entirety.

BACKGROUND

1. Technical Field

The present disclosure relates to a heat exchanger and a home appliance including the heat exchanger.

2. Description of the Related Art

There are many types of heat exchangers, among them, a heat exchanger commonly used in a home appliance has a form in which a plurality of fins is coupled to an outer circumferential surface of a pipe. Inside the pipe, refrigerant flows, and the fins facilitate heat exchange between air and heat through the pipe.

As a usage time of the heat exchanger accumulates, rust or corrosion may occur on surfaces of the pipe or fins. In particular, when the pipe or fins are made of a metal material, natural oxidation of the metal occurs. In order to prevent this phenomenon, a coating-related technique to improve corrosion resistance on the surface of the heat exchanger is disclosed.

For example, a technique of coating zinc alloys on a surface of an aluminum tube to improve corrosion resistance of the aluminum tube is disclosed in Korean Patent Laid-Open Publication No. 2000-0060105 (published on Oct. 16, 2000). In the patent document, it is described that since a heat exchanger used as a condenser in an automobile structure is exposed to a corrosive environment in which a large amount of chloride or sulfide is present, coating zinc alloys can protect tubes from corrosion.

With regard to aluminum, research related to corrosion resistance improvement through coating is active, and numerous patent documents exist. Meanwhile, research related to improvement of corrosion resistance through coating is insufficient in relation to copper. In Korean Patent Laid-Open Publication No. 10-2005-0047855 (published on May 23, 2005), only a technique of oxidizing copper using an oxidation solution after plating copper on a surface of a heat exchanger is disclosed. The technology disclosed in the patent document is far from the purpose of preventing oxidation of copper in that it rather actively oxidizes copper.

Meanwhile, an occurrence of rust or corrosion in the heat exchanger is strongly influenced by surroundings in which the heat exchanger is used. For example, when a heat exchanger is used in a clothes treatment apparatus such as a dryer, as refrigerant evaporates from a heat exchanger used as an evaporator, water in the air, which is an object of heat exchange of the refrigerant, condenses, and condensate generated therefrom causes rust or corrosion.

In consideration of this point, a configuration in which a coating layer having a surface energy of up to 40 mN/m is formed on a surface of a heat exchanger used in a domestic dryer is disclosed in U.S. Pat. No. 8,375,596 B2 (Feb. 19, 2013, open). However, a concept of surface energy of 40 mN/m disclosed in the patent document is unclear, and it is only mentioned that a coating layer is formed on various metal surfaces with a material containing polysiloxane resin. Especially for copper, a specificity in how to form a coating layer with what material is poorly described.

Accordingly, it is necessary to develop a technology for a coating capable of preventing rust or corrosion of a heat exchanger made of copper material without deteriorating heat exchange performance, which is an original purpose of the heat exchanger.

In particular, copper pipes are welded in a manufacturing process of the heat exchanger, and a tendency of rust or corrosion of the heat exchanger to occur in weld zones is very strong. Since this tendency is due to structural limitations of weld zones, there is a need for a technique to solve the limitations.

Furthermore, when a heat exchanger to which a coating capable of preventing rust or corrosion is applied is installed in a home appliance, deterioration of the coating may occur in a subsequent process. Accordingly, it is necessary to develop a method for preventing deterioration in the coating of the heat exchanger in the manufacturing process of home appliances.

SUMMARY

One aspect of the present disclosure is to propose a configuration capable of preventing rust or corrosion on a surface of a heat exchanger by coating. In particular, the present disclosure is to propose a configuration capable of preventing rust or corrosion on a copper pipe.

Another aspect of the present disclosure is to provide a dimension of a weld zone that can suppress rust or corrosion that easily occurs on a weld zone of a copper pipe.

Another aspect of the present disclosure is to present a thickness of a coating layer that effectively prevents rust or corrosion.

Another aspect of the present disclosure is to provide a method for manufacturing a home appliance having a configuration capable of preventing a pre-formed coating layer from being deteriorated in a subsequent welding process during the manufacturing process of the home appliance including a heat exchanger.

To achieve the above aspect and other advantages of the present disclosure, there is provided a heat exchanger according to an embodiment of the present disclosure, including a coating layer formed on a surface of a copper pipe, wherein the coating layer provides corrosion resistance to the copper pipe.

The copper pipe includes straight tubes and return bends. At both ends of the straight tube, burrs having a circumference greater than an outer diameter of the straight tube due to expansion of the tube are formed, and a distance between a rim of the burr and an outer surface of the straight tube is 0.4 mm to 1.8 mm.

The coating layer may be formed of first to fourth coating materials.

The first coating material contains polyurethane resin.

The first coating material further contains xylene, dimethyl carbonate, and ethylbenzene in addition to the polyurethane resin.

The first coating material contains the polyurethane resin for 33.2 to 40 weight %, xylene for 30 to 31.7 weight %, dimethyl carbonate for 23.2 to 30 weight %, and ethylbenzene for 1 to 5.1 weight %.

The second coating material contains acryl and carbon.

The third coating material contains butyl cellosolve, isobutyl alcohol, n-butyl alcohol, bisphenol A diglycidyl ether, ethylbenzene, acrylic acid mixed polymer, xylene, and melamine resin.

The acrylic acid mixed polymer contains styrene, n-butyl methacrylate, 2-ethylhexylacrylate, and 2-hydroxyethyl acrylate.

In the third coating material, the butyl cellosolve accounts for 1 to 10 weight %, the isobutyl alcohol for 1 to 10 weight %, the n-butyl alcohol for 5 to 15 weight %, the bisphenol A diglycidyl ether for 1 to 10 weight %, the ethylbenzene for 15 to 25 weight %, the acrylic acid mixed polymer for 28 to 38 weight %, the xylene for 15 to 25 weight %, and the melamine resin for 5 to 15 weight %.

The fourth coating material contains polymeric resin, deodorized kerosene, methyl isobutyl ketone, n-butyl acetate, isobutyl alcohol, n-butyl alcohol, talc, barium sulfate, urea-melamine copolymer, silicone epoxy copolymer, propylene glycol methyl ether acetate (PGMEA), modified melamine-formaldehyde resin, and optional additives.

In the fourth coating material, the polymer resin accounts for 1 to 5 weight %, the deodorized kerosene for 5 to 10 weight %, the methyl isobutyl ketone for 5 to 10 weight %, the n-butyl acetate for 1 to 5 weight %, the isobutyl alcohol for 5 to 10 weight %, the n-butyl alcohol for 5 to 10 weight %, the talc for 5 to 10 weight %, the barium sulfate for 1 to 5 weight %, and the urea-melamine copolymer for 20 to 25 weight %, the silicone epoxy copolymer for 5 to 10 weight %, the PGMEA for 10 to 15 weight %, the modified melamine-formaldehyde resin for 1 to 5 weight %, and the optional additives for 10 to 20 weight %.

The heat exchanger includes copper pipes, a plurality of fins, and two end plates.

The copper pipe forms a refrigerant flow path.

The plurality of fins is arranged at positions spaced apart from each other along one direction, and coupled to an outer circumferential surface of the copper pipe.

The two end plates are made of galvanized sheet iron, and are disposed at positions spaced apart from each other with the plurality of fins therebetween.

The plurality of straight tubes extends along the arranged direction of the plurality of fins to penetrate the plurality of fins and the two end plates. The plurality of return bends connects one end of one of the plurality of straight tubes protruding outwardly of the two end plates to one end of another one of the plurality of straight tubes.

The coating layers are formed on surfaces of the plurality of return bends, surfaces of weld zones formed at both ends of each return bend, and surfaces of the burrs.

An inlet end and an outlet end of the copper pipe protrude in a direction toward an outer side of either one of the two end plates, connection pipes each having a length of 40 mm to 80 mm are connected to the inlet end and the outlet end, respectively, and weld zones are formed at both ends of the connection pipe.

The present disclosure provides a method for manufacturing a home appliance including a heat exchanger. The method for manufacturing a home appliance proposed in the present disclosure includes: expanding a plurality of straight tubes to form burrs having a circumference greater than an outer diameter of each straight tube at both ends of the straight tube; welding the straight tube to the return bend; and forming coating layers providing corrosion resistance on surfaces of the plurality of return bends, surfaces of the weld zones formed at both ends of each return bend, and surfaces of the burrs, wherein the step of forming burrs includes expanding tubes such that a distance between a rim of the burr and an outer surface of the straight tube is to be 0.4 mm to 1.8 mm.

The manufacturing method further includes: arranging the plurality of fins at positions spaced apart from each other along one direction, and inserting the straight tubes one by one for each through hole formed in the plurality of fins, prior to the step of forming burrs.

In the step of forming burrs, the plurality of straight tubes is expanded to allow the plurality of fins to be coupled to an outer circumferential surface of each straight tube.

Here, the coating layer is formed of first to fourth coating materials.

The heat exchanger further includes two end plates disposed at positions spaced apart from each other with the plurality of fins therebetween, The manufacturing method of the home appliance further includes welding one end of a connection pipe having a length of 40 mm to 80 mm to an inlet end and an outlet end of the copper pipe protruding in a direction toward an outer side of either one of the two end plates, respectively, between the step of welding and the step of forming coating layers.

The manufacturing method of the home appliance further includes welding another end of the connection pipe to a counterpart after the step of forming coating layers.

According to the present disclosure having the above configuration, since coating layers providing corrosion resistance are formed on surfaces of return bends, surfaces of weld zones formed at both ends of the return bend, and surfaces of burrs, rust or corrosion on the surfaces of the plate and the return bend can be suppressed or prevented when contacting moisture.

In particular, when a distance between a rim of the burr and an outer surface of the straight tube is less than 0.4 mm, welding may be impossible or leaking may occur due to a welding material. However, since the distance set in the present disclosure is 0.4 mm or more, such problems can be solved.

In addition, when the distance between the rim of the burr and the outer surface of the straight tube exceeds 1.8 mm, rust or corrosion is easily generated due to the structure. However, since the distance set in the present disclosure is 1.8 mm or more, such problems can be solved.

In particular, the coating layer made of the first coating material containing polyurethane resin provides corrosion resistance and waterproof performance, and thus is effective in preventing rust or corrosion generated due to condensate.

In addition, since the coating layer made of the second coating material containing acrylic and carbon materials provides corrosion resistance and suppressing a decrease of heat exchange rate, it is effective not only in preventing rust or corrosion, but also in maintaining the original performance of the heat exchanger.

In addition, the third coating material not only provides corrosion resistance to a target for coating layer, but also provides resistance to salt water, and furthermore, has a transparent property, thereby providing an aesthetic effect.

In addition, the fourth coating material provides excellent corrosion resistance and excellent resistance to salt water to the target for coating layer.

In addition, according to the present disclosure, one end of the connection pipe is firstly welded to the inlet end and the outlet end of the copper pipe, and after the coating layer is formed, another end of the connection pipe is subsequently welded to a counterpart, thereby suppressing a deterioration of the coating layer due to a heat generated in welding the connection pipe to the counterpart.

DETAILED DESCRIPTION

Hereinafter, a heat exchanger and a manufacturing method of a home appliance including the heat exchanger according to the present disclosure will be described in detail with reference to the drawings.

For the sake of brief description with reference to the drawings, the same or equivalent components will be provided with the same reference numbers, and description thereof will not be repeated.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Figure 1:
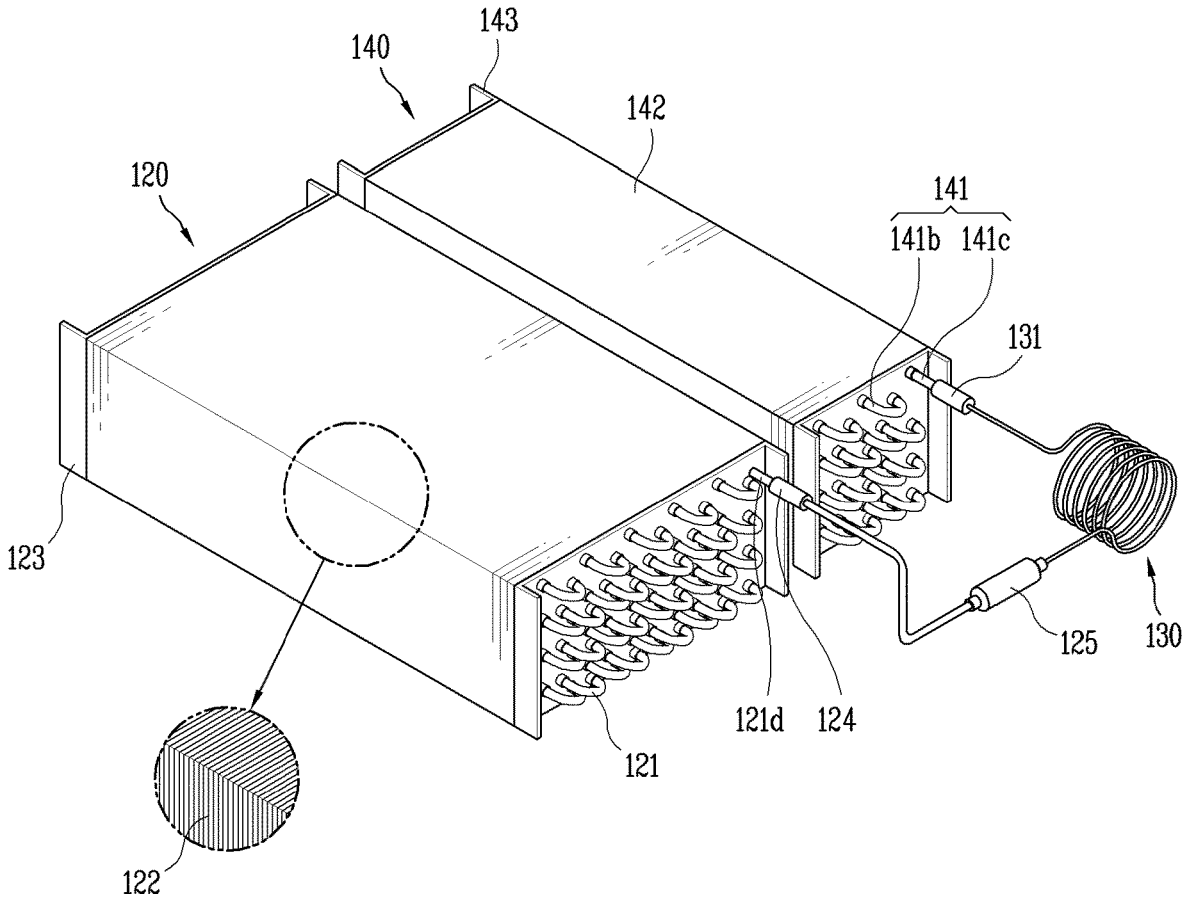
FIG. 1 is a perspective view of a heat exchanger related to an embodiment of the present disclosure and capillary tubes connected to the heat exchanger.

FIG. 1 is a perspective view of a heat exchanger 120, 140 related to an embodiment of the present disclosure, and an expander 130 connected to the heat exchanger 120, 140.

Figure 2:
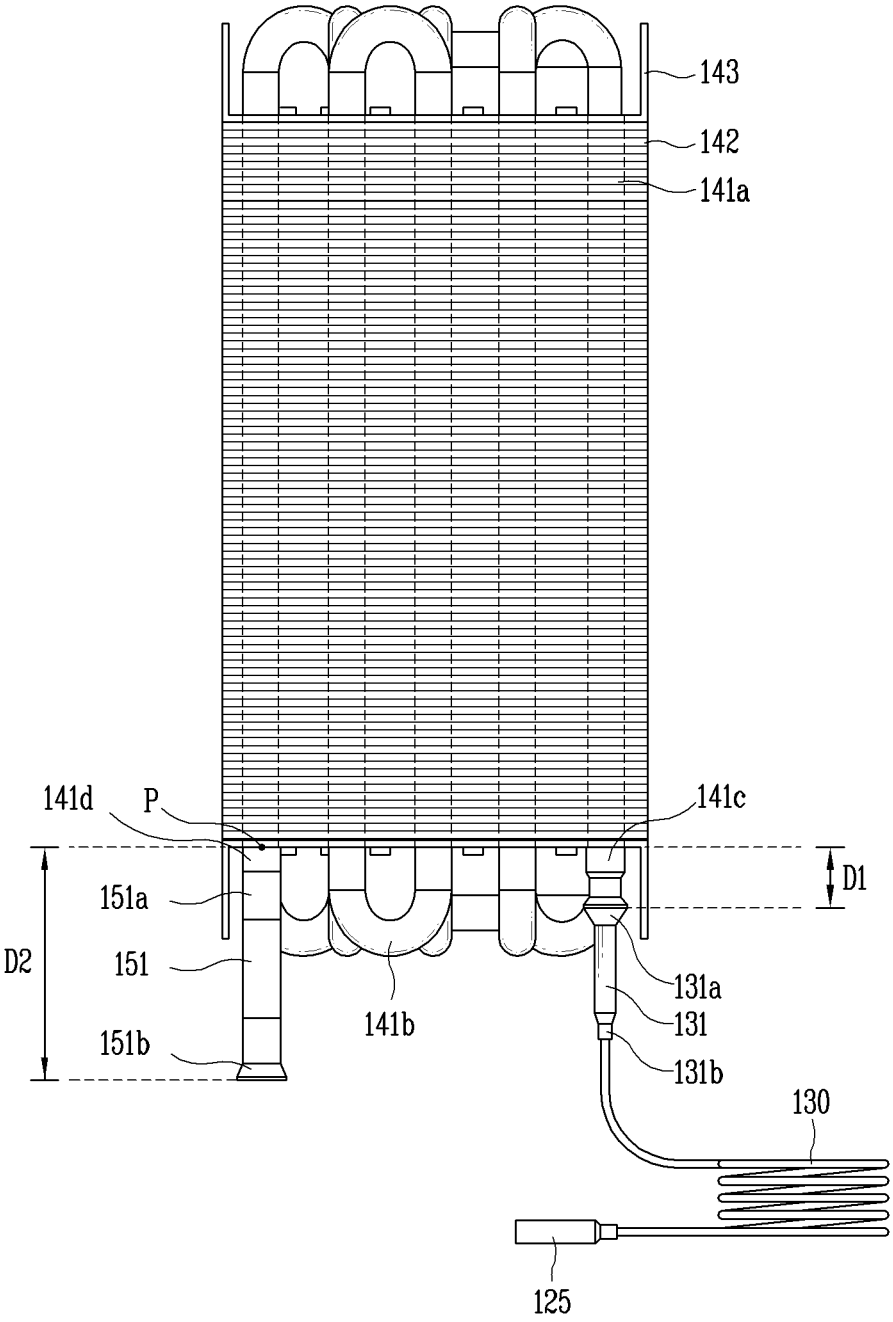
FIG. 2 is a planar view of an evaporator and capillary tubes connected to an evaporator illustrated in FIG. 1.

FIG. 2 is a planar view of an evaporator 140 and the expander 130 connected to the evaporator 140 illustrated in FIG. 1.

The heat exchanger 120, 140 is used as a condenser 120 or the evaporator 140 in a refrigeration cycle device or a heat pump cycle device.

The heat exchanger 120, 140 includes a copper pipe 121, 141, a plurality of fins 122, 142, and end plates 123, 143.

The copper pipe 121, 141 is made of a copper material and forms a circulation flow path of heat exchange fluid. The heat exchange fluid can be, for example, a refrigerant. The copper pipe 121, 141 has a structure that penetrates the plurality of fins 122, 142 in a linear direction, then penetrates the plurality of fins 122, 142 again by changing the direction at an outer side of the fins 122, 142.

The plurality of fins 122, 142 is formed in a shape of a flat square plate. The plurality of fins 122, 142 is arranged at positions spaced apart from each other along one direction. The plurality of fins 122, 142 is coupled to an outer circumferential surface of the copper pipe 121, 141. The plurality of fins 122, 142 may be made of stainless steel. The plurality of fins 122, 142 is intended to improve heat exchange efficiency of the heat exchanger 120, 140 by expanding heat exchange area.

The heat exchanger 120, 140 has two end plates 123, 143. The two end plates 123, 143 are disposed at positions spaced apart from each other with the plurality of fins 122, 142 therebetween. The end plates 123, 143 are disposed on outermost sides of the plurality of fins 122, 142, respectively. The end plates 123, 143 may be formed in a shape of a '□' in which both ends of a rectangular plate are protruding outwardly of the heat exchanger 120, 140. The end plates 123, 143 may be made of galvanized sheet iron.

The copper pipe 121, 141 includes a plurality of straight tubes 141*a* and a plurality of return bends 141*b*. The copper pipe 121, 141 has an inlet end 141*c* through which refrigerant flows in and an outlet end 121*d*, 141*d* through which refrigerant flows out, and the straight tubes 141*a* and the return bends 141*b* are alternately arranged from the inlet end 141*c* to the outlet end 121*d*, 141*d*.

The straight tube 141*a* extends in a linear direction along the arranged direction of the plurality of fins 122, 142 to penetrate the plurality of fins 122, 142 and the two end plates 123, 143. In addition, the return bend 141*b* is formed to connect one end of one of the plurality of straight tubes 141*a* protruding outwardly of the two end plates 123, 143 to one end of another one of the plurality of straight tubes 141*a*. The return bend 141*b* may be bent along a curve to have a C-shape. The straight tube 141*a* and the return bend may be joined to each other by welding.

The fins 122, 142 made of stainless steel have a very low probability of rust or corrosion, but the pipe 121, 141 made of copper and the end plates 123, 143 made of galvanized sheet iron have a probability of rust or corrosion. In particular, since copper is a material that is naturally oxidized, the possibility of rust or corrosion is very high.

Although both the straight tube 141*a* and the return bend 141*b* of the copper pipe 121, 141 can be rusted or corroded, the rust or corrosion generated in the straight tube 141*a* are not well visible because of the plurality of fins 122, 142 and end plates 123, 143. On the other hand, rust or corrosion generated in the return bend 141*b* is easily exposed visually.

The present disclosure provides the heat exchanger 120, 140 configured to suppress or prevent rust or corrosion with the coating layer formed on the surfaces of two end plates 123, 143 and/or the plurality of return bends 141*b*. The coating layer provides corrosion resistance to the surfaces of the two end plates 123, 143 and/or the plurality of return bends 141*b*.

There is a high tendency of rust or corrosion of the heat exchanger 120, 140 to occur in the weld zone of the straight tube 141*a* and the return bend 141*b*. Hereinafter, the structure of the weld zone capable of suppressing the occurrence of rust or corrosion will be described first, and then coating material forming the coating layer will be described.

Figure 3:
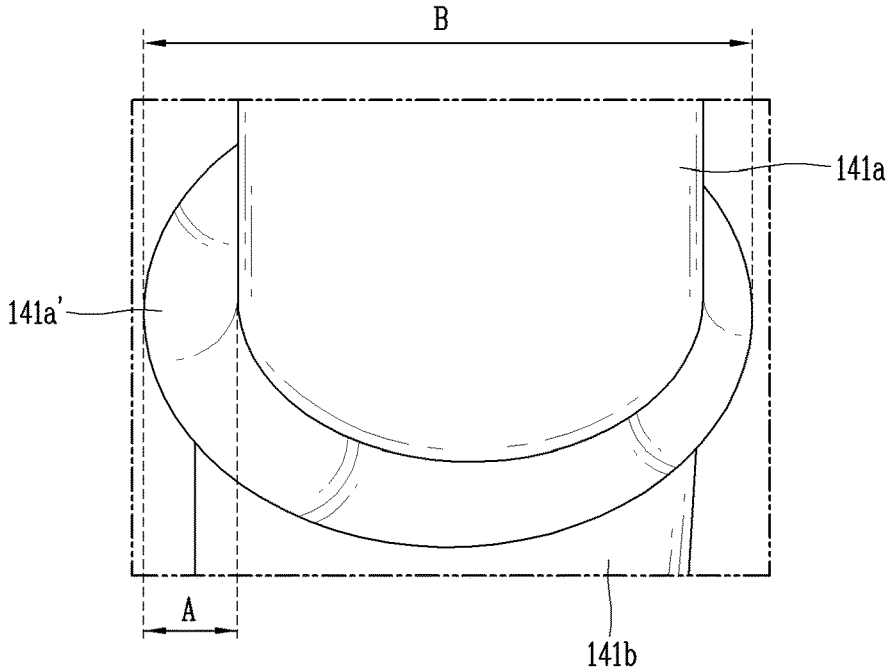
FIG. 3 is an enlarged conceptual view illustrating a weld zone of a straight tube and a return bend.

FIG. 3 is an enlarged conceptual view illustrating the weld zone of the straight tube 141*a* and the return bend 141*b*.

In the process of manufacturing the heat exchanger 120, 140, there is a step of inserting the straight tube 141*a* into a through hole of the fin 141*b* and expanding the tube. The straight tube 141*a* before expansion is referred to as a hair pin, and the expansion refers to a task of expanding an inner diameter and an outer diameter of the hair pin. Before expansion, an outer diameter of the hair pin is smaller than an inner diameter of the through hole formed in the fin, but after expansion, the outer diameter of the straight tube 141*a* is identical to the inner diameter of the through hole, so that the fin can be fixed to an outer circumferential surface of the straight tube 141*a*.

As a result of expansion, burrs 141*a*' are formed at both ends of the straight tube 141*a*. The burr 141*a*' is a result of expanding the tube having a circumference larger than the outer diameter of the straight tube 141*a*, and the burr corresponds to a portion joined with the return bend 141*b* by welding. Assuming that the straight tube 141*a* and the return bend 141*b* have the same outer diameter, the burr 141*a*' has a circumference larger than an outer diameter of the return bend 141*b*.

When the burr 141*a*' and the return bend 141*b* are closely contacted to be welded, a weld zone is formed between the burr 141*a*' and the return bend 141*b*. However, a size of the burr 141*a*' acts as an important structural factor that causes rust or corrosion of the weld zone. Therefore, in order to secure corrosion resistance of the heat exchanger 120, 140, it is important to set the size of the burr 141*a*'.

When a distance A between a rim of the burr 141*a*' and an outer surface of the return bend 141*b* is less than 0.4 mm, welding may not be possible due to an excessively small welding area. Even if welding is performed, not only leakage may occur, but also welding material melts during welding, thereby causing rust or corrosion. On the other hand, when the distance A is greater than 1.8 mm, it will act as a strong structural factor that causes rust or corrosion.

Accordingly, the present disclosure proposes to set the distance between the rim of the burr 141*a*' and the outer surface of the return bend 141*b* to be 0.4 mm to 1.8 mm. The distance between the rim of the burr 141*a*' and the outer surface of the return bend 141*b* may be understood as a range in which the burr 141*a*' protrudes from the outer surface of the straight tube 141*a* in a radial direction of the straight tube 141*a* having a cylindrical shape. In this case, a diameter B of the burr 141*a*' may be 10 mm to 12 mm.

The burr 141*a*' is not formed only on the straight tube 141*a*, but may be formed at both ends of the return bend 141*b*. The burr 141*a*' of the straight tube 141*a* is a result of expansion, but the return bend 141*b* may not undergo a separate expansion process, so the burr 141*a*' of the return bend 141*b* may be formed in a manufacturing process of the return bend 141*b*.

The coating layer providing corrosion resistance to prevent rust or corrosion is formed on the surface of the return bend 141*b*, the surfaces of the weld zones formed at both ends of the return bend 141*b*, and the surface of the burr 141*a*'. Additionally, the coating layer may be formed on the surfaces of the end plates 123, 143.

The coating layer is formed of a coating material. The coating material corresponds to any one of first to fourth coating material.

The first coating material contains polyurethane resin. The first coating material may further contain xylene, dimethyl carbonate, and ethylbenzene in addition to the polyurethane resin. In the first coating material, the polyurethane resin may account for 33.2 to 40 weight %, xylene for 30 to 31.7 weight %, dimethyl carbonate for 23.2 to 30 weight %, and ethylbenzene for 1 to 5.1 weight %.

When the coating layer is formed of the first coating material having the above composition, the coating layer provides not only corrosion resistance but also waterproof performance. When the heat exchanger 120, 140 is used as the evaporator 140 in a home appliance, this may cause rust or corrosion on the surface of the return bend 141*b*, the surfaces of weld zones at both ends of the return bend 141*b*, and the surface of the burr 141*a*'. However, since the coating layer formed of the first coating material provides waterproof performance, rust or corrosion can be suppressed or prevented.

The second coating material contains acryl and carbon. When the coating layer is formed of the second coating material, the coating layer provides corrosion resistance. In particular, since the second coating material contains a carbon component, it has an effect of preventing a decrease in heat exchange efficiency after coating.

The third coating material contains butyl cellosolve, isobutyl alcohol, n-butyl alcohol, bisphenol A diglycidyl ether, ethylbenzene, acrylic acid mixed polymer, xylene, and melamine resin.

Here, the acrylic acid mixed polymer refers to a polymer containing styrene, n-butyl methacrylate, 2-ethylhexylacrylate, and 2-hydroxyethyl acrylate.

In the third coating material, the butyl cellosolve accounts for 1 to 10 weight %, the isobutyl alcohol for 1 to 10 weight %, the n-butyl alcohol for 5 to 15 weight %, the bisphenol A diglycidyl ether for 1 to 10 weight %, the ethylbenzene for 15 to 25 weight %, the acrylic acid mixed polymer for 28 to 38 weight %, the xylene for 15 to 25 weight %, and the melamine resin for 5 to 15 weight %.

The third coating material having the above composition not only provides corrosion resistance to a target for the coating layer, but also provides resistance to salt water, and furthermore, has a transparent property, thereby providing an aesthetic effect.

The fourth coating material contains polymeric resin, deodorized kerosene, methyl isobutyl ketone, n-butyl acetate, isobutyl alcohol, n-butyl alcohol, talc, barium sulfate, urea-melamine copolymer, silicone epoxy copolymer, propylene glycol methyl ether acetate (PGMEA), modified melamine-formaldehyde resin, and optional additives.

Here, the optional additives may be, for example, pigments that impart color to the fourth coating material, or preservatives for long-term preservation of the fourth coating material.

In the fourth coating material, the polymer resin accounts for 1 to 5 weight %, the deodorized kerosene for 5 to 10 weight %, the methyl isobutyl ketone for 5 to 10 weight %, the n-butyl acetate for 1 to 5 weight %, the isobutyl alcohol for 5 to 10 weight %, the n-butyl alcohol for 5 to 10 weight %, the talc for 5 to 10 weight %, the barium sulfate for 1 to 5 weight %, and the urea-melamine copolymer for 20 to 25 weight %, the silicone epoxy copolymer for 5 to 10 weight %, the PGMEA for 10 to 15 weight %, the modified melamine-formaldehyde resin for 1 to 5 weight %, and the optional additives for 10 to 20 weight %.

The fourth coating material having the above composition provides excellent corrosion resistance and excellent resistance to salt water to the target for the coating layer.

Meanwhile, a thickness of the coating layer should be 20 μm or more. This is because when the thickness of the coating layer is thinner than 20 μm, it is insufficient to prevent rust or corrosion due to the insufficient thickness, and also lacks resistance to salt water. The thicker the coating layer is, the more effective it is to prevent rust and corrosion. However, when the thickness of the coating layer exceeds 46 μm, the effect is saturated and its degree of improvement in the effect of preventing rust and corrosion is insufficient. Therefore, the thickness of the coating layer is preferably 20 to 46 μm.

The coating layer may be formed by a sequential process of application of coating material and curing. The coating material may be applied by various methods such as powder coating, spraying, and dipping.

For example, an electrostatic spraying method may be used to form the coating layer. The electrostatic spraying method means a method for coating an entire or partial area in a thin film form in a non-contact manner.

The coating layer may be formed using an acrylic coating material such as AC 3000 by the electrostatic spraying method, and may have a thickness of approximately 20 μm or more in order to secure corrosion resistance of a bent portion. When using the electrostatic spraying method, the coating layer is formed by spraying coating material about two times toward a left side and a right side, and then drying it at about 180° C. for 15 minutes or more. Reliability for such a coating layer may be secured by a salt water spray test, by allowing a rust generation rate of the coating layer to be approximately 5% or less.

Meanwhile, the inlet end 141*c* is formed at one end of the copper pipe 121, 141 that repeatedly penetrates the plurality of fins 122, 142, and the outlet end 121*d*, 141*d* is formed at another end of the copper pipe 121, 141. The inlet end 141*c* refers to a portion where the heat exchange fluid flows into the heat exchanger 120, 140, and the outlet end 121*d*, 141*d* refers to a portion where the heat exchange fluid is discharged from the heat exchanger 120, 140.

The inlet end 141*c* is connected to a counterpart disposed on an upstream side of the heat exchanger 120, 140 based on the flow of the refrigerant, and the outlet end 121*d*, 141*d* is connected to a counterpart disposed on a downstream side of the heat exchanger 120, 140 based on the flow of the refrigerant. For example, when the heat exchanger 120, 140 is applied to the evaporator 140 of the refrigeration cycle, the inlet end 141*c* is connected to the expander 130 and the outlet end 121*d*, 141*d* is connected to a gas-liquid separator or compressor. The inlet end 141*c* and the outlet end 121*d*, 141*d* protrude in a direction toward an outer side of either one of the two end plates 123, 143. An inner side of the end plates 123, 143 means a direction in which the plurality of fins 122, 142 is provided, and the outer side of the end plates 123, 143 means a direction opposite to the direction in which the plurality of fins 122, 142 is provided based on the end plates 123, 143. A length in which the inlet end 141*c* and the outlet end 121*d*, 141*d* protrude from the end plates 123, 143 may be about 12 mm.

When pipes connecting the inlet end 141*c* and the outlet end 121*d*, 141*d* to the counterparts are directly welded to the inlet end 141*c* and the outlet end 121*d*, 141*d*, weld zones are formed at a portion connecting the inlet end 141*c* and the pipe, and a portion connecting the outlet end 121*d*, 141*d* and the pipe, respectively. The positions where the weld zones are formed are naturally limited by lengths of the inlet end 141*c* and the outlet end 121*d*, 141*d* protruding from the end plates 123, 143. For example, when a protruding length D1 of the inlet end 141*c* and the outlet end 121*d*, 141*d* is about 12 mm, a length from the end plates 123, 143 to the weld zone is also about 12 mm.

When the length from the end plates 123, 143 to the weld zone is about 12 mm, high heat in the welding process may affect the coating layer. Therefore, it is not preferable to perform welding after the coating layer is formed. Accordingly, in the present disclosure, it is proposed to firstly connect the connection pipes 124, 131, and 151 each having a length of 40 mm to 80 mm to the inlet end 141*c* and the outlet end 121*d*, 141*d*, respectively, by welding, then form coating layers on the heat exchanger 120, 140 to which the connection pipes 124, 131, and 151 are connected, and lastly, weld the connection pipes 124, 131, and 151 to counterparts or other pipes.

Here, the counterparts refer to devices such as the expander 130, the gas-liquid separator, the compressor, etc. disposed on the upstream side or the downstream side of the heat exchanger 120, 140 in the refrigeration cycle, and the other pipes refer to pipes connecting the counterparts with the connection pipes 124, 131, and 151.

One end 131*a*, 151*a* of the connection pipe 124, 131, 151 is connected to the inlet end 141*c* or the outlet end 121*d*, 141*d*, and another end of the connection pipe 124, 131, 151 is connected to the counterpart or another pipe. In this case, weld zones are formed both at one end 131*a*, 151*a* and another end 131*b*, 151*b* of the connection pipe 124, 131, 151.

When the one end 131*a*, 151*a* of the connection pipe 124, 131, 151 each having a length of 40 mm to 80 mm is welded to the inlet end 141*c* and the outlet end 121*d*, 141*d*, the another end 131*b*, 151*b* of the connection pipe 124, 131, 151 is provided at a position corresponding to a sum D2=a+b of a protruding length a in which the inlet end 141*c* or the outlet end 121*d*, 141*d* protrudes from the end plates 123, 143, and a length b of the connection pipe 124, 131, 151. The another end 131*b*, 151*b* of the connection pipe 124, 131, 151 is formed at a position sufficiently far from the end plates 123, 143, so that even if a weld zone is formed at the another end 131*b*, 151*b* of the connection pipe 124, 131, 151 after the coating layer is formed, the coating layer is not affected.

This will be described later with reference to FIG. 4.

Figure 4:
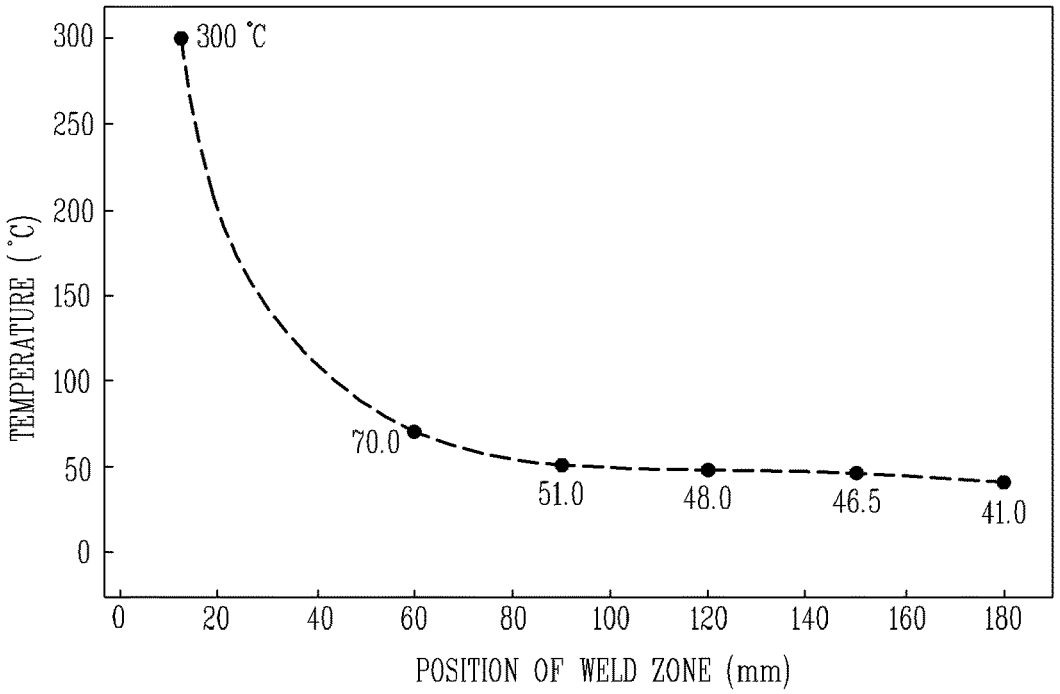
FIG. 4 is a graph showing results of measuring temperature of a pipe according to positions of the weld zone.

FIG. 4 is a graph showing results of measuring the temperature of the pipe according to positions of the weld zone.

A horizontal axis of the graph denotes positions of the weld zone, and the position of the weld zone denotes a distance from the end plate to a position where the weld zone is formed. It means that the smaller the value of the position of the weld zone is, the closer the distance between the welding zone and the end plate is. Meanwhile, a vertical axis of the graph denotes temperature.

A dotted line in the graph denotes temperatures for each position when welding is performed at a position 12 mm apart from the end plate. Referring to the graph with the dotted line, it can be seen that the temperature decreases as the position of the weld zone moves away from the end plate.

Meanwhile, the temperatures indicated as dots denote the temperature of the end plate when welding is performed at each position. For example, when welding is performed at a position spaced 60 mm apart from the end plate, the temperature of the end plate is about 70° C.

In order to prevent deterioration of the already formed coating layer in a subsequent process of welding, the temperature of the end plate and the return bend where the coating layer is formed should be 100° C. or less. Therefore, according to the result of FIG. 4, when one end of the connection pipe having a length of 40 mm to 80 mm is welded to the inlet end and the outlet end before the coating layer is formed, the coating layer is not deteriorated even if the another end of the connection pipe is welded after the coating layer is formed.

Hereinafter, a method for manufacturing a home appliance having the heat exchanger described above will be described.

Figure 5:
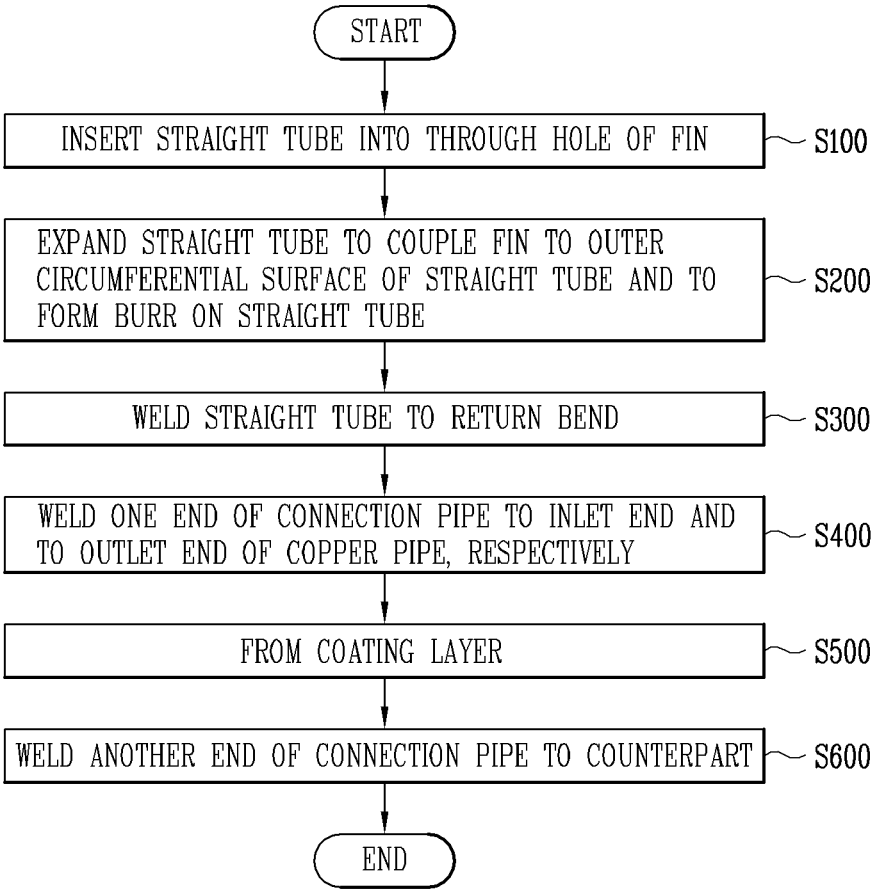
FIG. 5 is a flowchart of a method for manufacturing a home appliance according to an embodiment of the present disclosure.
Figure 6:
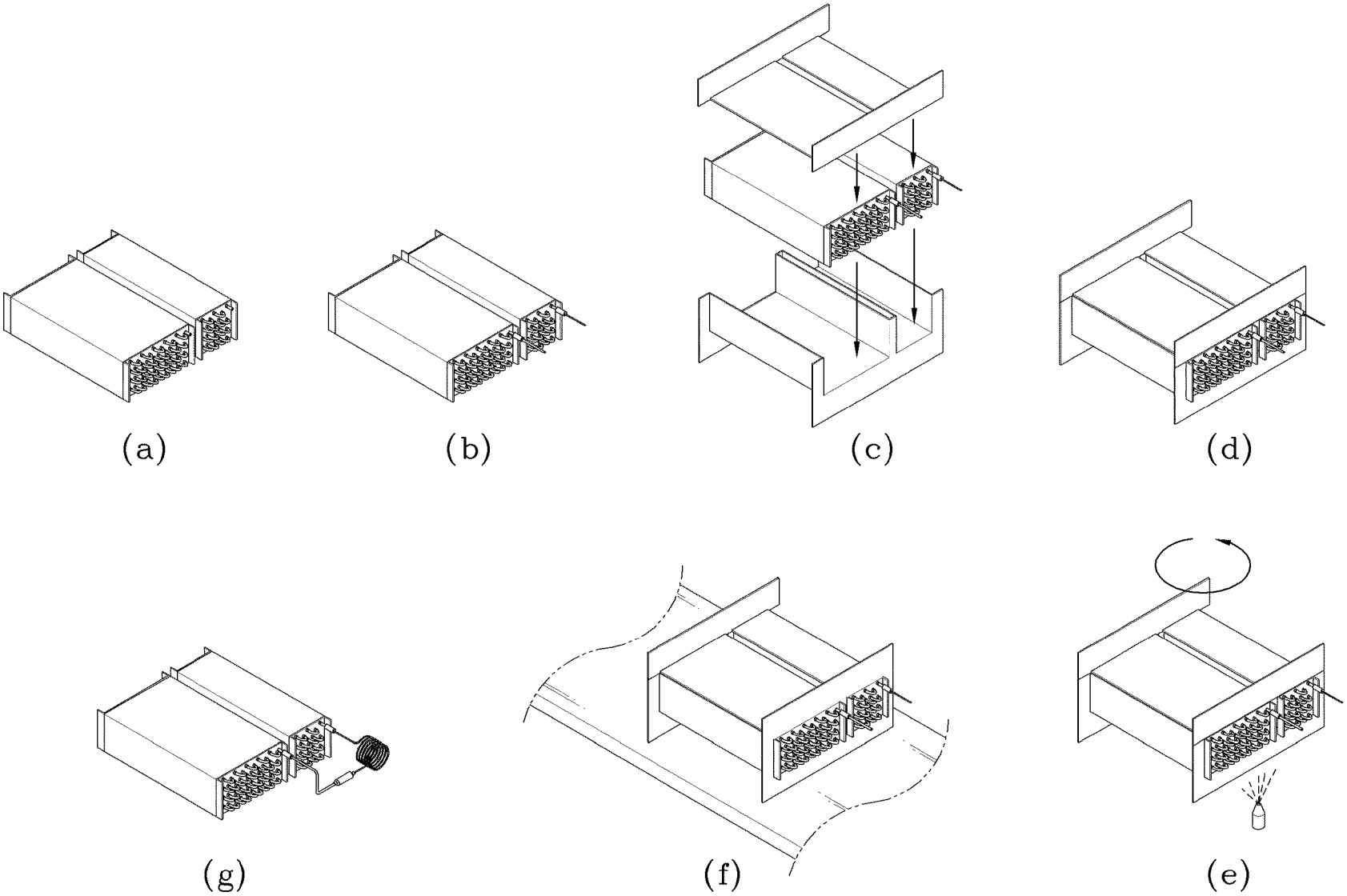
FIG. 6 is a conceptual view illustrating a step of forming a coating layer and a step before and after that in a manufacturing process of the home appliance according to the manufacturing method of FIG. 5.

FIG. 5 is a flowchart of a method for manufacturing a home appliance according to an embodiment of the present disclosure. FIG. 6 is a conceptual view illustrating a step of forming a coating layer and a step before and after that in the manufacturing process of the home appliance according to the manufacturing method of FIG. 5.

In order for a home appliance to be manufactured, it has to go through numerous steps. In the present disclosure, a process of forming a coating layer of the heat exchanger and applying the coating layer to the home appliance while manufacturing the home appliance will be described.

Firstly, heat exchangers HX1 and HX2 including copper pipes, fins, and end plates are prepared.

In general, in order to manufacture heat exchangers HX1 and HX2, straight tubes before expansion, called hair pins, are inserted into a plurality of fins (S100 in FIG. 4). The plurality of fins is arranged in a row or in multiple rows, but has through holes at same positions, so that the hair pins can be inserted into the through holes in one direction. A diameter of the through hole formed in the plurality of fins is larger than the outer diameter of the hair pin.

Subsequently, a straight tube is formed by expanding the outer diameter and an inner diameter of the hair pin, and then the plurality of fins is coupled to the outer circumferential surface of the straight tube. In addition, the expansion is performed to form burrs at both ends of the straight tube. The expansion should be performed such that a distance between the rim of the burr and the outer surface of the straight tube is 0.4 mm to 1.8 mm.

Next, each of the end plates is disposed at an outermost side of the plurality of fins, and a return bend is welded to the straight tube to complete the production of the heat exchanger (S300 in FIG. 4).

When the heat exchanger to be applied to the home appliance is provided ((a) of FIG. 6), connection pipes 124 and 131 having lengths of 40 mm or more are welded to an inlet end and an outlet end of the copper pipe, respectively (S400 in FIG. 5, (b) of FIG. 6). Here, one end of the connection pipe 124, 131 is welded to the inlet end or the outlet end of the copper pipe. As described above, when one end of the connection pipe 124, 131 is welded to the inlet end or the outlet end, the coating layer is not affected by the subsequent welding process performed in step S600, which will be described later.

When the welding of the connection pipe 124, 131 is completed, coating layers are formed on a surface of the return bend, weld zones formed at both ends of the return bend, and the burr (S500). In order to form a coating layer, the welded heat exchanger is mounted on masking jigs Z1 and Z2 ((c) and (d) of FIG. 6). The masking jigs Z1 and Z2 are formed to cover the heat exchanger except for both ends thereof, and a coating layer cannot be formed on a portion covered by the masking jigs Z1 and Z2. The masking jigs Z1 and Z2 expose two end plates, a plurality of return bends exposed through the end plates, the inlet end and the outlet end, and a connecting pipe, and enclose rest of them.

When the heat exchanger is seated on the masking jigs Z1 and Z2, coating is performed ((e) and (f) of FIG. 6). The first to fourth coating materials described above may be used for coating, and the coating layer formed by the coating material provides corrosion resistance.

The coating layer is formed by a sequential process of applying a coating material ((e) of FIG. 6) and curing ((f) of FIG. 6). For the application of the coating material, methods such as powder coating, spraying, and dipping can be used. The heat exchanger on which the coating layer is formed is seated on a fixture capable of rotating the heat exchanger, and after applying the coating material to one side of the heat exchanger by the above methods, the heat exchanger is rotated by the fixture, and on another side of the heat exchanger, the coating material is applied by the above methods. For curing, a natural drying at room temperature or a thermosetting method may be used.

Here, in order to form a coating layer in the heat exchanger, an electrostatic spraying method may be used. The electrostatic spraying method means a method for coating an entire or partial area in a thin film form in a non-contact manner.

A thickness of the coating layer may be approximately 20 μm or more to secure corrosion resistance of the bent portion by spraying an acrylic coating material such as AC 3000 by the electrostatic spraying method. When using the electrostatic spraying method, the coating layer is formed by spraying coating material about two times toward a left side and a right side, and then drying it at about 180° C. for 15 minutes or more. Reliability for such a coating layer may be secured by a salt water spray test, by allowing a rust generation rate of the coating layer to be approximately 5% or less.

Finally, after the heat exchanger on which the coating layer has been formed is detached from the masking jig, a counterpart is welded to the another end of the connection pipe to connect them together (S600 in FIG. 5, (g) of FIG. 6). The counterpart refers to a pipe connected to a filter dryer 125 and a pipe connected to the expander 130, etc.

Between the removal of the masking jig and the welding of the counterpart, a process of seating the heat exchanger and the counterpart on a base of the home appliance to be manufactured may be added. Here, the base of the home appliance refers to an object that receives or supports the heat exchanger and the counterpart.

According to this method, one end of the connection pipe is firstly welded to the inlet end and the outlet end of the heat exchanger, and after the coating layer is formed, the another end of the connection pipe is subsequently welded to the counterpart. One end of the connection pipe is close to the end plate, while another end of the connection pipe is located away from the end plate, so that the coating layer may not be affected by heat generated in a post welding process.

Hereinafter, the home appliance having the heat exchanger described above will be described.

Figure 7:
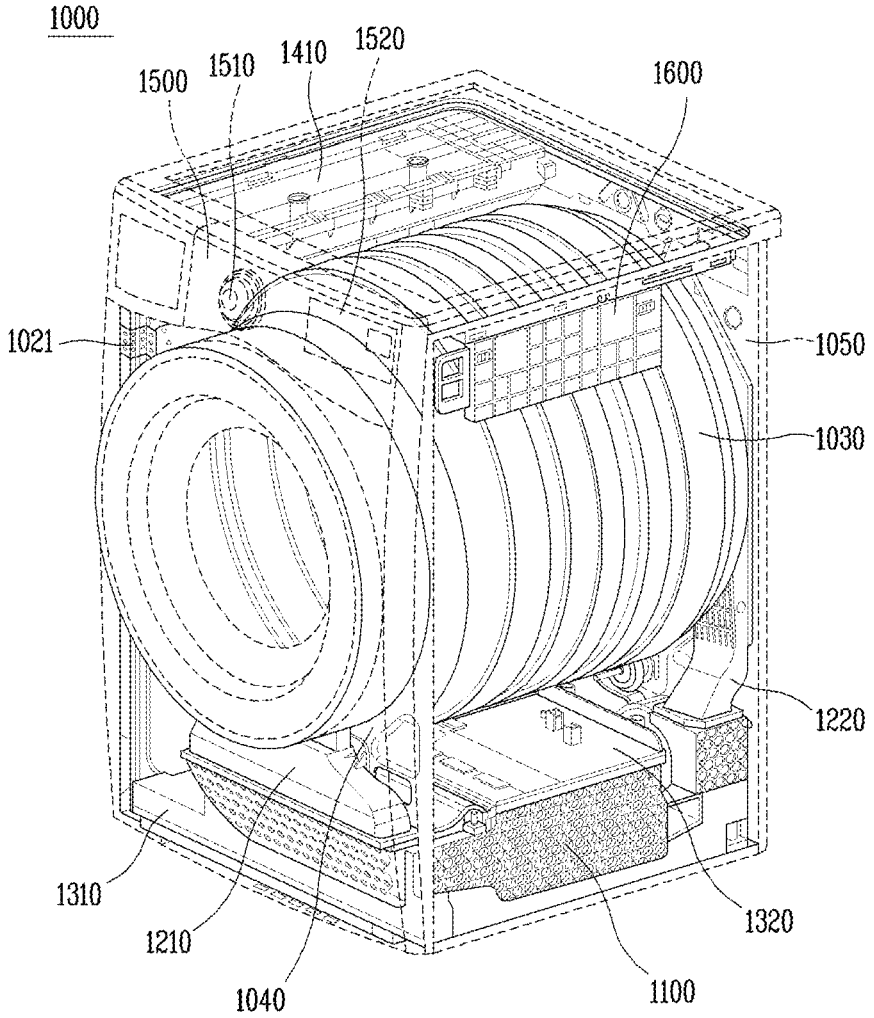
FIG. 7 is a perspective view of a clothes treating apparatus explaining an example of a heat exchanger proposed in the present disclosure.

FIG. 7 is a perspective view of a clothes treating apparatus explaining an example of the heat exchanger proposed in the present disclosure.

A cabinet 1010 defines an appearance of the clothes treating apparatus 1000. The cabinet 1010 includes a plurality of sub-cabinets including at least one of a front surface, a rear surface, left and right surfaces, upper and lower surfaces of the clothes treating apparatus 1000. The sub-cabinet may be made of a metal plate or a synthetic resin material.

The sub-cabinet forming a base of the clothes treating apparatus 1000 may be referred to as a base cabinet 1310. The base cabinet 1310 is made of a synthetic resin material, and provides a space in which various components are mounted. The base cabinet 1310 may form a bottom surface of the clothes treating apparatus 1000 by itself, or a base plate made of a metal material may be mounted under the base cabinet 1310 to be placed on the bottom surface.

A clothes inlet is formed on a front surface portion of the cabinet 1010. The clothes inlet is configured to communicate with an opening at a front side of a drum 1030, so that objects to be treated such as clothes or bedding are introduced into the drum 1030 therethrough.

A door 1020 is configured to open and close the clothes inlet. The door 1020 may be rotatably connected to the cabinet 1010 by a hinge 1021. The door 1020 may include a light-transmitting portion. Therefore, even if the door 1020 is closed, inside of the drum 1030 may be visually exposed through the light-transmitting portion.

The drum 1030 is rotatably installed inside the cabinet 1010. The drum 1030 is defined in an empty cylindrical shape opened toward front and rear sides, and an opening at a front side of the drum 1030 communicates with the clothes inlet, so that objects to be treated is accommodated in the drum 1030.

Heat pump cycle devices 1100 are disposed below the drum 1030. Here, the below the drum 1030 means a space between a lower portion of the drum 1030 and the base cabinet 1310. The heat pump cycle devices 1100 refer to devices that configure a cycle to evaporate, compress, condense, and expand refrigerant, sequentially. When the heat pump cycle devices 1100 are operated, the heat pump cycle devices 1100 become hot and dry as sequentially exchanging heat with the heat exchangers of the heat pump cycle devices 1100.

The base cover 1320 is configured to cover the base cabinet 1310. When the base cabinet 1310 and the base cover 1320 are combined, a circulation flow path in which an inlet and an outlet thereof are closed is formed. An upstream of the circulation flow path is connected to a front duct connector 1210. And a downstream of the circulation flow path is connected to a rear duct connector 1220.

The front duct connector 1210 is connected to the opening at the front side of the drum 1030, and the rear duct connector 1220 is connected to an opening at a rear side of the drum 1030. The front duct connector 1210 may be referred to as an outlet duct in that the front duct connector 1210 forms a flow path through which air inside the drum 1030 is discharged. The rear duct connector 1220 may be referred to as an inlet duct in that the rear duct connector 1220 forms a flow path through which air is introduced into the drum 1030.

Air humidified after drying the object to be treated inside the drum 1030 is guided by the front duct connector 1220 to exchange heat with the heat exchanger of the heat pump cycle devices 1100. Air, from which water is removed through the heat exchange then heated, flows back into the drum 1030 through the rear duct connector 1220.

When air exchanges heat with the heat exchanger of the heat pump cycle devices 1100, condensate is generated. More specifically, when the temperature of the air decreases due to heat exchange, a saturation amount of water vapor contained in the air decreases. Since the air recovered through the front duct connector 1210 contains moisture exceeding the saturation amount of water vapor, condensate is inevitably generated.

A water container 1410 is configured to collect condensate. The water container 1410 is disposed on an upper left side or an upper right side of the drum 1030. In other words, the water container 1410 is disposed in an empty space in an upper left portion or an empty space in an upper right portion between an upper portion of the drum 1030 and the cabinet 1010. In FIG. 7, the water container 1410 is illustrated as being disposed on the upper left portion of the drum 1030.

A water container cover 1420 is disposed at the upper left side or upper right side at the front surface portion of the clothes treating apparatus 1000 to correspond to a position of the water container 1410. The water container cover 1420 is configured to be gripped by hand, and is exposed a front surface of the clothes treating apparatus 1000. When pulling the water container cover 1420 to empty the condensate collected in the water container 1410, the water container 1410 is withdrawn together with the water container cover 1420.

An input/output panel 1500 is provided on the front surface or a top surface of the clothes treating apparatus 1000. In FIG. 7, the input/output panel 1500 is illustrated as being disposed next to the water container 1420. The input/output panel 1500 may include an input unit 1510 to receive a selection of a clothes treating course from a user, and an output unit 1520 visually displaying an operating state of the clothes treating apparatus 1000.

The input unit 1510 may be configured as a jog dial, but is not limited thereto. The output unit 1520 may be configured to visually display an operating state of the clothes treating apparatus 1000. The clothes treating apparatus 1000 may have a separate configuration for audible display in addition to visual display.

A control unit (controller) 1600 is configured to control an operation of the clothes treating apparatus 1000 based on a user input applied through the input unit 1510. The control unit 1600 may include a circuit board and elements mounted on the circuit board. When the user selects a clothes treating course through the input unit 1510, the control unit 1600 controls the operation of the clothes treating apparatus 1000 according to a preset algorithm.

Figure 8:
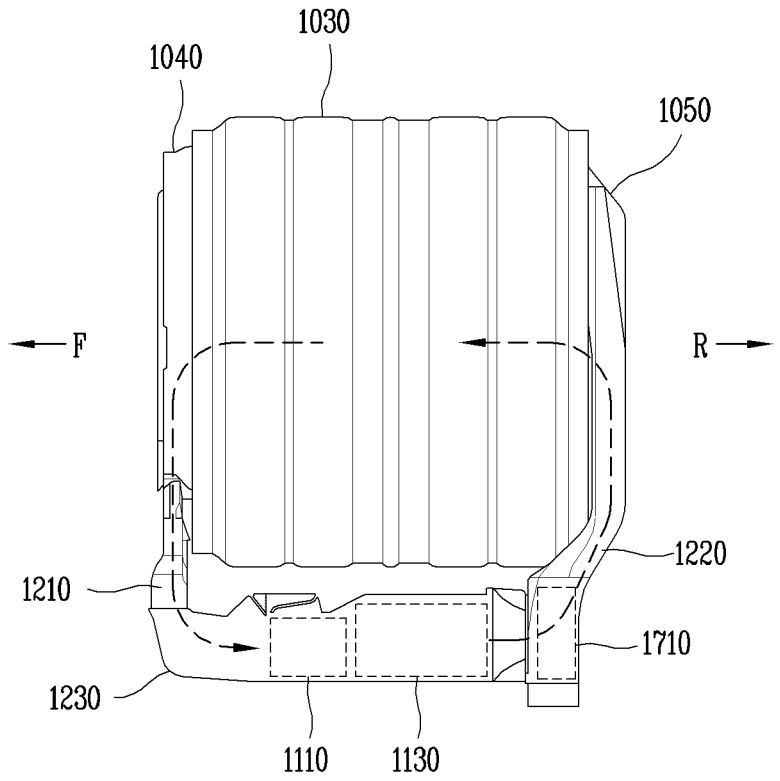
FIG. 8 is a conceptual view to describe a circulation of air through a drum and a circulation flow path illustrated in FIG. 7.

FIG. 8 is a conceptual view to describe a circulation of air through the drum and the circulation flow path illustrated in FIG. 7. In FIG. 8, a left side corresponds to a front side F of the drum 1030, and a right side corresponds to a rear side R of the drum 1030.

In order to dry objects to be treated put into the drum 1030, a process of supplying hot and dry air to the interior of the drum 1030, recovering the air that has dried the clothes, removing moisture from the air then heating the air, and resupplying the air to the drum shall be repeated. In order to repeat this process in a condensation type dryer, air must continuously circulate through the drum 1030. Circulation of air is made through the drum 1030 and a circulation flow path 1200.

The circulation flow path 1200 is formed by the front duct connector 1210, the rear duct connector 1220, and a connecting duct 1230 disposed between the front duct connector 1210 and the rear duct connector 1220. Each of the front duct connector 1210, the rear duct connector 1220, and the connecting duct 1230 may be formed by combining a plurality of members.

The drum 1030, the front duct connector 1210, the connecting duct 1230, and the rear duct connector 1220 are sequentially connected based on the flow of air, and the rear duct connector 1220 is again connected to the drum 1030 to form a closed flow path.

An opening corresponding to a front opening 1030' of the drum for the input of the object to be treated is formed at a front supporter 1040, and a communication hole communicating with the front duct connector 1210 is formed at a lower side thereof.

The front duct connector 1210 extends downwardly from the front supporter 1040 to the connecting duct 1230. The air that has dried the object to be treated in the drum 1030 is recovered into the connecting duct 1230 through the front duct connector 1210.

An evaporator 1140 and a condenser 1120 among the heat pump cycle devices 1100 are installed inside the connecting duct 1230. In addition, a circulation fan 1710 to supply hot and dry air to the rear duct connector 1220 is also installed inside the connecting duct 1230.

The evaporator 1140 is disposed at an upstream side of the condenser 1120 based on the flow of air, and the circulation fan 1710 is disposed at a downstream side of the condenser 1120. The circulation fan 1710 sucks air from the condenser 1120 and generates wind in a direction supplying the air to the rear duct connector 1220.

The rear duct connector 1220 extends upwardly from the connecting duct 1230 to cover a rear surface of a rear supporter 1050 and communicates with ventilation holes formed at the rear supporter 1050. The rear surface of the rear supporter 1050 refers to a surface facing a rear side of the clothes treating apparatus 1000. The hot and dry air is supplied to the interior of the drum 1030 through the ventilation holes.

Since the drum 1030 and the connecting duct 1230 are spaced apart from each other along a vertical direction, the rear duct connector 1220 extends upwardly from the connecting duct 1230 disposed under the drum 1030 to the rear side of the drum 1030. Like the front duct connector 1210, the rear duct connector 1220 may also extend in the vertical direction, but a length of the vertical extension of the rear duct connector 1220 is longer than the front duct connector 1210 due to the connection structure.

Figure 9:
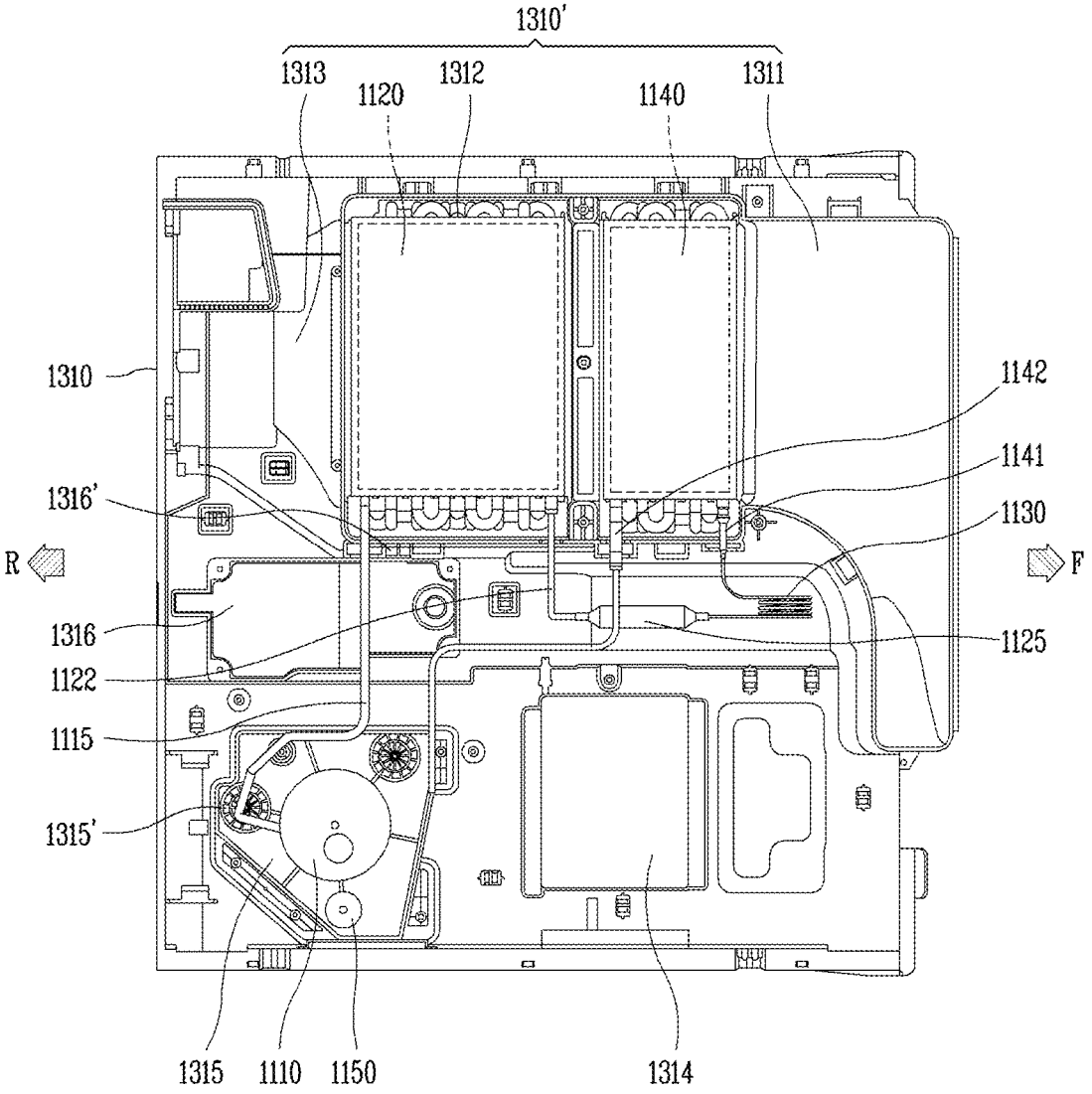
FIG. 9 is a planar view of a base cabinet illustrated in FIG. 7 and heat pump cycle devices mounted to the base cabinet.

FIG. 9 is a planar view of a base cabinet illustrated in FIG. 7 and heat pump cycle devices mounted to the base cabinet.

The base cabinet 1310 is provided under the drum 1030 to provide a space in which various components are mounted, including heat pump cycle devices 1100.

A drum motor mounting portion 1314, a compressor mounting portion 1315, a base flow path portion 1310', and a condensate recovery portion 1316 are provided in the base cabinet 1310. The drum motor mounting portion 1314 and the compressor mounting portion 1315 are disposed on one side of the base flow path portion 1310'. This embodiment illustrates that the drum motor mounting portion 1314 and the compressor mounting portion 1315 are disposed at a left front side and a left rear side of the base flow path portion 1310', respectively.

A drum motor (not illustrated) that generates a driving force to rotate the drum 1030 is mounted on the drum motor mounting portion 1314. A belt (not illustrated) to transmit the driving force of the drum motor 1800 to the drum 1030 may be connected to the drum motor 1800. The belt is disposed to surround an outer circumference of the drum 1030.

A compressor 1110 configured to compress refrigerant is mounted on the compressor mounting portion 1315. Since the compressor 1110 is an element comprising the heat pump cycle devices 1100 but does not directly exchange heat with air, the compressor 1110 does not need to be installed in the base flow path portion 1310'. Rather, when the compressor 1110 is installed in the base flow path portion 1310', it may interrupt the flow of the air, so the compressor 1110 is preferably installed outside the base flow path portion 1310'.

The refrigerant evaporates (liquid→gas) while absorbing heat from the evaporator 1140, becomes a low-temperature and low-pressure gas state, and is sucked into the compressor 1110. A gas-liquid separator 1150 is installed at an upstream side of the compressor 1110 based on the flow of the refrigerant. The gas-liquid separator 1150 separates the refrigerant flowing into the compressor 1110 into a gas phase and a liquid phase, so that only the gas phase refrigerant flows into the compressor 1110. Accordingly, a problem in which a liquid refrigerant flows into the compressor 1110 to cause a malfunction or a decrease in efficiency can be prevented.

The compressor mounting portion 1315 has a fixing rib 1315' to fix the compressor 1110 on at least three positions. In order to reduce vibration, the fixing rib 1315' may extend to the rear surface through the compressor mounting portion 1315. The fixing rib 1315' extended to the rear surface is configured not to contact the bottom surface.

The base flow path portion 1310' forms a part of the circulation flow path 1200. Based on the flow of air, the base flow path portion 1310' is divided into a guide portion 1311, a heat exchange portion 1312, and a circulation fan accommodating portion 1313. The evaporator 1140 and the condenser 1120 are disposed in the heat exchange portion 1312, and a circulation fan (not illustrated) is disposed in the circulation fan accommodating portion 1313 to face the condenser 1120.

The guide portion 1311 corresponds to a portion through which air discharged from the front opening of the drum 1030 flows in. An opening opened upwardly is formed at the guide portion 1311, and the opening communicates with the front duct connector 1210. A direction of air flowing downwardly through the front duct connector 1210 is switched to face the rear side of the base cabinet 1310 in the guide portion 1311, then introduced into the heat exchange portion 1312.

The heat exchange portion 1312 corresponds to a portion in which the evaporator 1140 to remove moisture from the air introduced from the guide portion 1311 and the condenser 1120 to heat the air from which moisture is removed are installed. The heat exchange portion 1312 may extend in a straight line from the front side toward the rear side of the base cabinet 1310.

The refrigerant compressed in the compressor 1110 becomes a high-temperature and high-pressure state, and flows to the condenser 1120 through a pipe 1115. In the condenser 1120, the refrigerant is liquefied while releasing heat. The liquefied high-pressure refrigerant is introduced into the filter dryer 1125 through a pipe 1122 to be filtered in the filter dryer 1125. The refrigerant is then decompressed in an expander 1130. The low-temperature and low-pressure liquid refrigerant is introduced into the evaporator 1140. The refrigerant evaporated from the evaporator 1140 is circulated through the gas-liquid separator 1150 to the compressor 1110.

Referring to FIG. 9, it can be seen that an Inlet end and an outlet end of the evaporator 1140 are connected to connection pipes 1141 and 1142, respectively. It has been described above that from the end plate of the evaporator 1140 to the weld zone can be spaced apart by the connection pipes 1141 and 1142.

The circulation fan accommodating portion 1313 corresponds to a portion in which the circulation fan to suck and blow air passing through the heat exchange portion 1312 is accommodated. The circulation fan is configured as a sirocco fan that blows air at the front side, that is, air heated while passing through the condenser 1120 to a side.

The hot and dry air that has passed through the condenser 1120 is supplied to the drum 1030 through the rear duct connector 1220. The hot and dry air supplied to the drum 1030 evaporates moisture from the object to be treated, then becomes hot and humid air. The hot and humid air is recovered through the front duct connector 1210, and exchanges heat in an evaporator 1140*f* with the refrigerant to become low-temperature air. Here, as the temperature of the air is lowered, the saturation amount of water vapor in the air decreases, and the vapor contained in the air is condensed. Subsequently, the low-temperature dry air exchanges heat with the refrigerant in the condenser 1120, becomes high-temperature dry air, and is again supplied to the drum 1030.

The evaporator 1140 and the condenser 1120 mounted on the base flow path 1310' are eccentrically positioned to one side from a center of the base cabinet 1310. That is, the flow path after the guide portion 1311 in the base flow path portion 1310' extends toward the rear side from a position eccentric from the center of the base cabinet 1310.

The condensate recovery portion 1316 is provided between the base flow path portion 1310' and the compressor mounting portion 1315. The condensate recovery portion 1316 communicates with the base flow path portion 1310' to form a space into which condensate generated in the evaporator 1140 is recovered. This embodiment illustrates that the condensate recovery portion 1316 is configured to communicate with the heat exchange portion 1312.

A water pump (not illustrated) is installed in the condensate recovery portion 1316. The water pump is configured to transmit the condensate collected in the condensate recovery portion 1316 to the water container 1410 (see, FIG. 7). The condensate transmitted to the water tank 1410 is transmitted by the water pump to be used for cleaning the evaporator 1140.

The condensate recovery portion 1316 may protrude in a form of a partition wall from one surface of the base cabinet 1310, or may be recessed at one surface of the base cabinet 1310 as in the present embodiment.

A communication hole 1316' to communicate the heat exchange portion 1312 with the condensate recovery portion 1316 may be provided at one rear end of the condenser 1120. The condensate generated in the evaporator 1140 falls to a bottom surface of the heat exchanger 1312, then is introduced into the condensate recovery portion 1316 through the communication hole 1316'. The heat exchange portion 1312 may be inclined toward the communication hole 1316' so that the condensate can be moved to the communication hole 1316' by gravity.

The clothes treating apparatus 1000 corresponds to an example of the home appliance to which the heat exchanger proposed in the present disclosure is applied. The heat exchanger proposed in the present disclosure may be applied to all home appliances to which a refrigeration cycle or a heat pump cycle is applied.

The heat exchanger and the home appliance including the same described above is not limited to the configurations and the methods of the embodiments described above, but the embodiments may be configured by selectively combining all or part of the embodiments so that various modifications or changes can be made.

What is claimed is:

1. A clothes dryer comprising:

a cabinet;

a drum disposed in the cabinet and configured to receive clothes therein; and a heat exchanger configured to (i) remove moisture from the clothes in the drum or (ii) increase a temperature of air in the drum, wherein the heat exchanger comprises:

a copper pipe defining a refrigerant circulation passage, a plurality of fins arranged in parallel and spaced apart from each other, the plurality of fins being coupled to an outer circumferential surface of the copper pipe, a plurality of end plates that are spaced apart from each other, the plurality of fins being disposed between the plurality of end plates, and a connection pipe that defines weld zones at both ends, that is connected to at least one of an inlet end or an outlet end of the copper pipe, and that has a length in a range from 40 mm to 80 mm, wherein the copper pipe comprises:

a plurality of straight tubes that each extends along a direction of the plurality of fins, and a plurality of return bends connected to the plurality of straight tubes, each of the plurality of the return bends being welded to two of the plurality of straight tubes, and each end of the plurality of return bends being connected to one end of the plurality of straight tubes, respectively, and wherein a coating layer is applied to (i) a surface of each of the plurality of end plates, (ii) each of the plurality of return bends located at the surface of each of the plurality of end plates, and (iii) a surface of the connection pipe.

2. The clothes dryer of claim 1, wherein the coating layer is applied to the connection pipe spanning from 16 mm away from a first end of the connection pipe to 48 mm away from the first end of the connection pipe.

3. The clothes dryer of claim 1, wherein the heat exchanger comprises an evaporator configured to evaporate refrigerant to remove moisture from the clothes in the drum, and wherein an inlet end of the evaporator is connected to an expansion valve by welding an evaporator inlet connection pipe at the inlet end of the evaporator.

4. The clothes dryer of claim 3, wherein the coating layer is applied to the evaporator inlet connection pipe spanning from 16 mm away from a first end of the evaporator inlet connection pipe to 48 mm away from the first end of the evaporator inlet connection pipe.

5. The clothes dryer of claim 1, wherein the heat exchanger comprises an evaporator configured to evaporate refrigerant to remove moisture from the clothes in the drum, and wherein an outlet end of the evaporator is connected to a compressor by welding an evaporator outlet connection pipe at the outlet end of the evaporator.

6. The clothes dryer of claim 5, wherein the coating layer is applied to the evaporator outlet connection pipe spanning from 16 mm away from a first end of the evaporator outlet connection pipe to 48 mm away from the first end of the evaporator outlet connection pipe.

7. The clothes dryer of claim 1, wherein the heat exchanger comprises a condenser configured to compress refrigerant and supply hot air to the clothes in the drum, and wherein an inlet end of the condenser is connected to a compressor by welding a condenser inlet connection pipe at the inlet end of the condenser.

8. The clothes dryer of claim 7, wherein the coating layer is applied to the condenser inlet connection pipe spans from 16 mm away from a first end of the condenser inlet connection pipe to 48 mm away from the first end of the condenser inlet connection pipe.

9. The clothes dryer of claim 1, wherein the heat exchanger comprises a condenser configured to compress refrigerant and supply hot air to the clothes in the drum, and wherein an outlet end of the condenser is connected to an expansion valve by welding a condenser outlet connection pipe at the outlet end of the condenser.

10. The clothes dryer of claim 9, wherein the coating layer is applied to the condenser outlet connection pipe spanning from 16 mm away from a first end of the condenser outlet connection pipe to 48 mm away from the first end of the condenser outlet connection pipe.

11. The clothes dryer of claim 1, wherein the coating layer is made of materials including: polyurethane resin, xylene, dimethyl carbonate, and ethylbenzene.

12. The clothes dryer of claim 1, wherein the coating layer is made of materials including: butyl cellosolve, isobutyl alcohol, n-butyl alcohol, bisphenol A diglycidyl ether, ethylbenzene, acrylic acid mixed polymer, xylene, and melamine resin.

13. The clothes dryer of claim 1, wherein the coating layer is made of materials including: polymeric resin, deodorized kerosene, methyl isobutyl ketone, n-butyl acetate, isobutyl alcohol, n-butyl alcohol, talc, barium sulfate, urea-melamine copolymer, silicone epoxy copolymer, propylene glycol methyl ether acetate (PGMEA), modified melamine-formaldehyde resin, and optional additives.

14. The clothes dryer of claim 1, wherein a length from each of the plurality of end plates to the connection pipe spans from 60 mm to 80 mm, wherein a first coating layer has a length spanning from 28 mm to 58 mm and is applied to the connection pipe from each of the plurality of end plates, and wherein the first coating layer has a thickness spanning from 20 μm to 60 μm.

15. The clothes dryer of claim 1, wherein both ends of the plurality of straight tubes are configured to, based on expansion of the plurality of straight tubes, provide burrs.

16. The clothes dryer of claim 15, wherein the burrs have a circumference greater than an outer diameter of each of the plurality of straight tubes.

17. The clothes dryer of claim 15, wherein a distance between a rim of the burrs and an outer surface of the plurality of straight tubes spans from 0.4 mm to 1.8 mm.

18. The clothes dryer of claim 15, wherein a diameter of each of the burrs spans from 10 mm to 12 mm.

19. The clothes dryer of claim 15, wherein at least a portion of coating layer is applied to a surface of the burrs.

20. The clothes dryer of claim 1, wherein the coating layer is configured to block formation of rust.

* * * * *